US006655720B2

(12) United States Patent
Rampen

(10) Patent No.: US 6,655,720 B2
(45) Date of Patent: Dec. 2, 2003

(54) LOCK WITH PLUNGER UNIT

(76) Inventor: Edmond L. Rampen, 260 King Street, Oakville, Ontario (CA), L6J 1B7

( * ) Notice: Subject to any disclaimer, the term of this patent is extended or adjusted under 35 U.S.C. 154(b) by 0 days.

(21) Appl. No.: 09/972,064

(22) Filed: Oct. 9, 2001

(65) Prior Publication Data

US 2003/0067174 A1 Apr. 10, 2003

(51) Int. Cl.[7] ..... E05C 5/00; E05C 1/08

(52) U.S. Cl. ..... 292/61; 292/57; 292/60; 292/67; 292/163

(58) Field of Search ..... 292/57, 58, 60, 292/61, 71, 67, DIG. 46, 337, DIG. 60, 175, 137, 163, 164, 62; 70/461

(56) References Cited

U.S. PATENT DOCUMENTS 2,845,789 A * 8/1958 Kistner ..... 292/57
3,179,454 A * 4/1965 Mummenday ..... 292/170
3,315,998 A * 4/1967 Dallaire ..... 292/337
3,779,588 A * 12/1973 Raymon ..... 292/57
4,066,284 A * 1/1978 Ikemura ..... 292/62
4,138,150 A * 2/1979 Bills ..... 292/60
4,635,327 A * 1/1987 Netznik ..... 24/653
5,275,029 A * 1/1994 Myers ..... 292/60
6,102,452 A * 8/2000 Liau ..... 292/145
6,299,223 B1 * 10/2001 Ji et al. ..... 292/175

* cited by examiner

*Primary Examiner*—Anthony Knight
*Assistant Examiner*—Michael J. Kyle
(74) *Attorney, Agent, or Firm*—Robert F. Delbridge

(57) ABSTRACT

A lock for preventing one member from moving relative to another member has a housing securable to one member, and a plunger unit mounted in the housing. The plunger unit has a sleeve, a plunger slidably mounted in the sleeve, and a spring acting between the plunger and the sleeve to resiliently bias the plunger to a locking position in which a free end portion of the plunger projects from one end of the sleeve. The plunger also has a manually operable portion projecting from an opposite end of the sleeve. In the locking position, the free end portion of the plunger projects from the housing to extend into an aperture in the other member, when the housing is secured to the one member, and thereby prevent relative movement between the members. The plunger also has an unlocking position in which the free end portion thereof is withdrawn from the aperture in the other member by pulling the manually operable portion against the action of the spring.

6 Claims, 4 Drawing Sheets

LOCK WITH PLUNGER UNIT

FIELD OF INVENTION

This invention relates to locks for preventing one member from sliding relative to another member. One of the members may for example be a patio door, a window or a cupboard door, with the other member being an associated frame member.

BACKGROUND OF INVENTION

Many such locks are known, but there is still a need for an improved lock of this kind which is more effective than known locks but which nevertheless is relatively simple and not unduly expensive.

It is therefore an object of the invention to provide an improved lock of this kind.

SUMMARY OF INVENTION

According to the invention, a lock for preventing one member from moving relative to another member has a housing securable to one member and a plunger unit mounted in the housing. The plunger unit has a sleeve, a plunger slidably mounted in the sleeve, and a spring acting between the plunger and the sleeve to resiliently bias the plunger to a locking position in which a free end portion of the plunger projects from one end of the sleeve, the plunger also having a manually operable portion projecting from an opposite end of the sleeve. In the locking position, the free end portion of the plunger projects from the housing to extend into an aperture in the other member, when the housing is secured to said one member, and thereby prevent relative sliding movement between the members. The plunger also has an unlocking position in which the free end portion thereof is withdrawn from the aperture in the other member by pulling the manually operable portion against the action of the spring. The housing may include a main portion and a cover portion removably securable thereto, the main portion and the cover portion having longitudinally extending recesses receiving the plunger unit. The cover portion may be attachable to the main portion by sliding movement relative thereto, and the cover portion and the housing portion may have mutually engaging keyways to enable the sliding movement to be effected The spring may be a helical spring which surrounds the plunger within the sleeve.

The manually operable portion and the free end portion of the plunger may be separate parts secured together by screw-threaded engagement, the separate parts being separable to enable the spring to be assembled with the plunger and the sleeve.

The sleeve and the housing may have inter-engaging means to prevent movement of the sleeve relative to the housing. A plurality of longitudinally-spaced inter-engaging means may be provided to enable the amount of projection of the free end portion of the plunger from the housing to be adjusted.

The manually operable portion of the plunger and the sleeve may have stop means which are mutually engageable by rotation of the manually operable portion of the plunger relative to the sleeve when the plunger is in its unlocking position to retain the plunger in the unlocking position.

BRIEF DESCRIPTION OF THE DRAWINGS

One embodiment of the invention will now be described, by way of example, with reference to the accompanying drawings, of which.

DESCRIPTION OF PREFERRED EMBODIMENT

Figure 1:
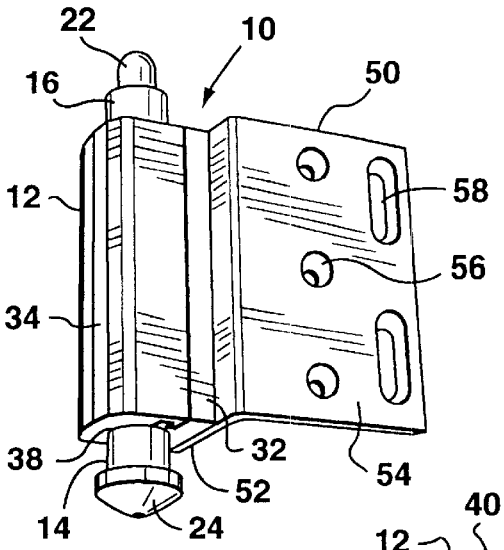
FIG. 1 is a perspective view from the front of a lock in accordance with one embodiment of the invention.
Figure 2:
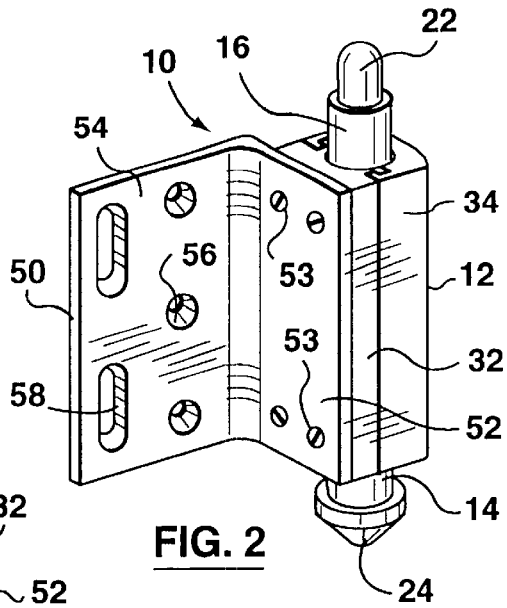
FIG. 2 is a similar view from the rear.
Figure 3:
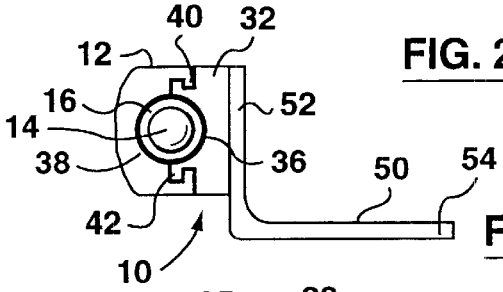
FIG. 3 is a top view of the lock.
Figure 4:
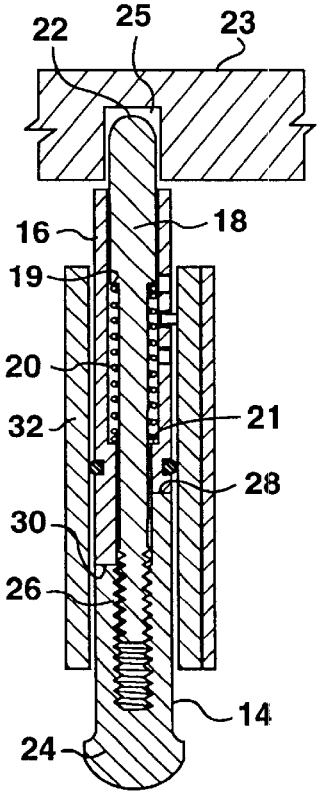
FIG. 4 is a longitudinal sectional view of the lock showing the plunger in the locking position.

Referring to the drawings, a lock 10 has a housing 12 and a plunger unit 14 mounted in the housing 12. The plunger unit 14 has a sleeve 16, a plunger 18 slidably mounted in the sleeve 16, and helical spring 20 surrounding the plunger 18 within the sleeve 16 and acting between an annular shoulder 19 on the plunger 18 and an annular shoulder 21 on the sleeve 16. The spring 20 resiliently biases the plunger 18 to a locking position in which a free end portion 22 of the plunger 18 projects from one end of the sleeve 16 as shown for example in FIGS. 1, 2 and 4.

The plunger 18 also has a manually operable portion 24 projecting from the opposite end of the plunger 16. The manually operable portion 24 and the free end portion 22 of the plunger 18 are separate parts secured together by screw-threaded engagement at 26. Thus, the manually operable portion 24 and the free end portion 22 of the plunger 18 are separable to enable the spring 20 to be assembled with the plunger 18 and the sleeve 16.

The plunger 18 also has an unlocking position in which the free end portion 22 thereof is withdrawn into the sleeve 16 by pulling the manually operable portion 24 against the action of the spring 20.

Figure 6:
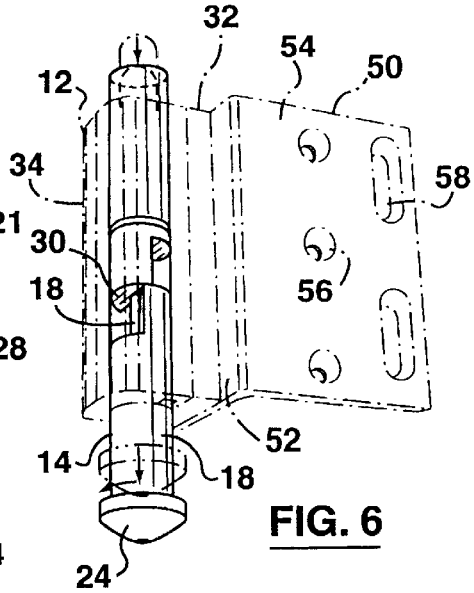
FIG. 6 is a perspective view of the plunger unit, with the housing portion being shown in phantom.

The manually operable portion 24 of the plunger 18 and the sleeve 16 have shaped adjacent ends 28, 30 respectively which form stop means which are mutually engageable by rotation of the plunger 18 relative to the sleeve 16 when the plunger is in the unlocking position (shown in FIG. 6) to retain the plunger 18 in the unlocking position.

The housing 12 has a main portion 32 and a cover portion 34 removably secured thereto, the main portion 32 and the cover portion 34 having longitudinally extending recesses 36, 38 respectively using the plunger unit 14. The main portion 32 and the cover portion 34 of the housing 12 also have pairs of inter-engaging longitudinally-extending keyways 40, 42 respectively on opposite sides to enable the cover portion 34 to be attached to and detached from the main portion 32 of the housing 12.

Figure 8:
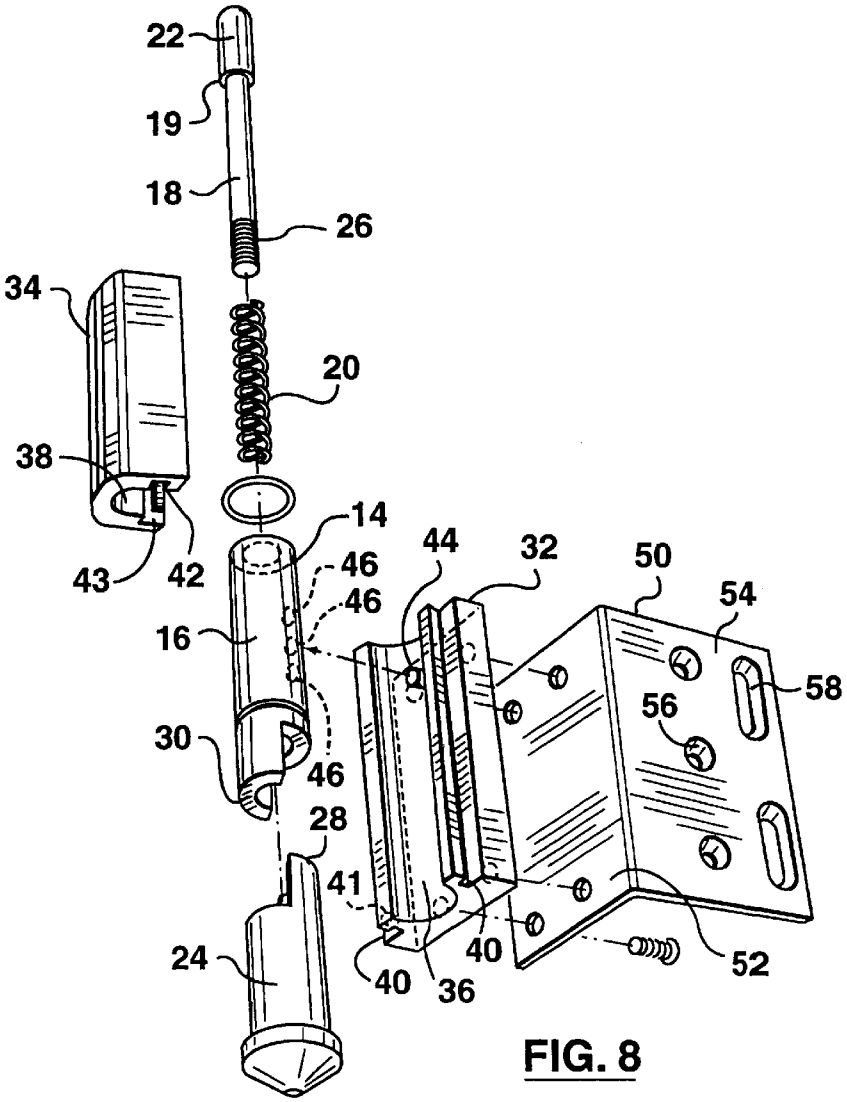
FIG. 8 is a similar view showing the various parts of the plunger unit.
Figure 7:
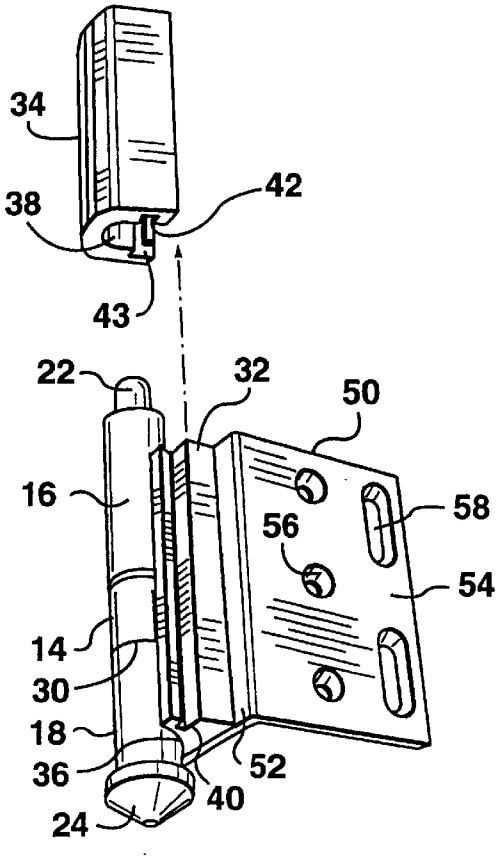
FIG. 7 is an exploded view of the lock showing the cover portion of the housing removed from the main portion thereof.

One of the keyways 42 in the cover portion 34 has an enlarged end portion 43 which receives a peg 41 at the corresponding end of the keyway 40 in the main housing portion 32 to provide stop means limiting sliding movement of the cover portion 34 relative to the main portion 32 so that the cover portion 34 becomes correctly positioned relative to the main housing portion 32 by engagement of the peg 14 with the junction between the enlarged end 43 and the remainder of the keyway 42. The sleeve 16 of the plunger unit 14 and the main housing portion 32 have inter-engaging means in the form of a small cylindrical peg 44 in the recess 36 of the main housing portion 32 and a longitudinally extending series of apertures 46 in the sleeve 16 to prevent movement of the sleeve 16 relative to the main housing portion 32, see FIG. 8. The plunger unit 14 is fitted into the recessed 36 in the main housing portion 32 by engaging the peg 44 into one of the apertures 46 in the sleeve 16, the aperture 46 selected determining the amount by which the free end portion 22 of the plunger 18 projects from the housing 12.

The rear face of the main housing portion 32 carries an L-shaped mounting bracket 50, with one L-arm 52 secured by screws 53 to the rear face of the main housing portion 32 and another L-arm 54. The L-arm 54 has circular apertures 56 on slots 58 to receive screws to enable the lock 10 to be secured to a member to be locked, as will be described in more detail shortly. The main portion 32 and the cover portion 34 of the housing 12 and the mounting bracket 50 may conveniently be aluminum extrusions.

Figure 9:
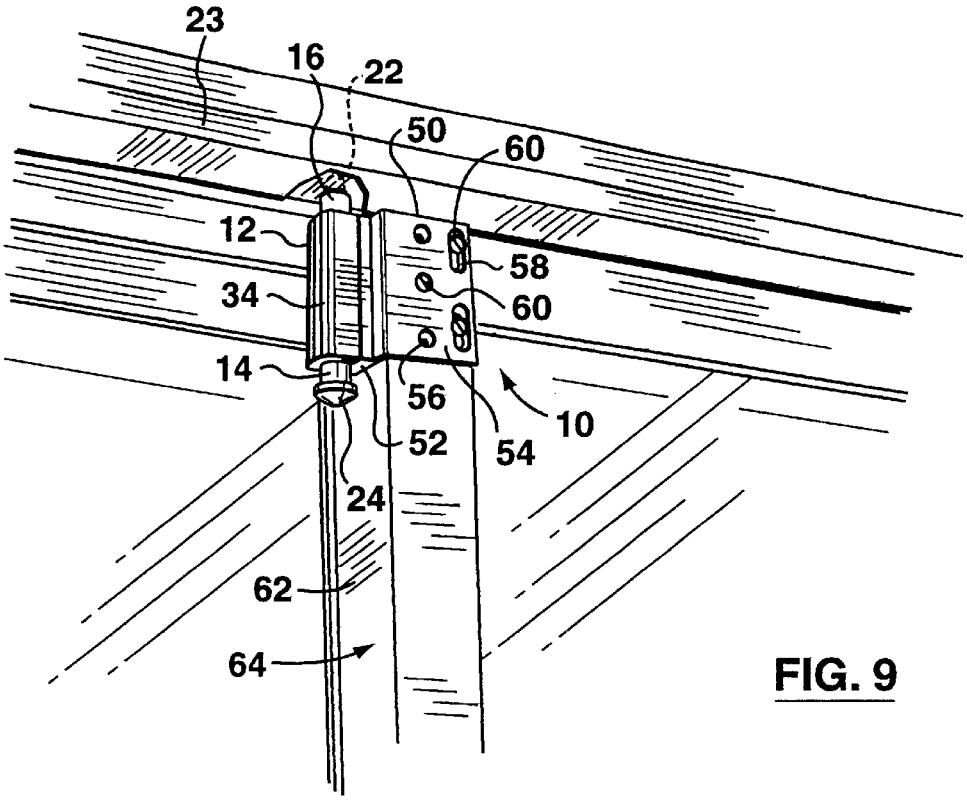
FIG. 9 is a perspective view of the lock secured to a patio door which opens from right to left.

FIG. 9 shows the lock 10 secured to a top corner of the frame 62 of a sliding patio door 64 which opens from left to right by screws 60 passing through the apertures 56 and/or slots 58 into the door frame 62. The plunger 18 is in the locking position (see FIG. 4), and the free end portion 22 of the plunger 18 extends into a drilled aperture 25 in the upper track 23 of the door 64. Thus, the door 64 cannot be opened by sliding movement, nor can it be lifted up out of its lower track (not shown).

Figure 5:
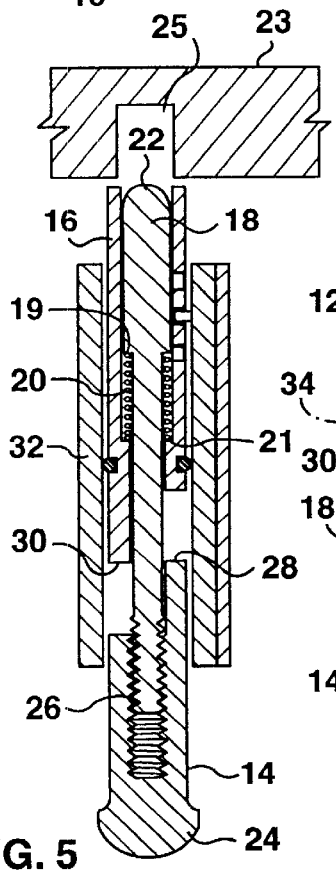
FIG. 5 is a similar view showing the plunger in the unlocking position.

The plunger 18 can be moved to the unlocking position (see FIG. 5) by simply pulling down on the plunger 18 by manually gripping the manually gripable portion 24. The plunger 18 can be caused to remain in the unlocking position by turning the plunger 18 by 180° from the position shown in FIG. 5 to the position shown in FIG. 6 so that the plunger 18 is retained in the unlocking position by engagement of the end surface 28 of the plunger 18 of the end surface 30 of the sleeve 16.

Figure 10:
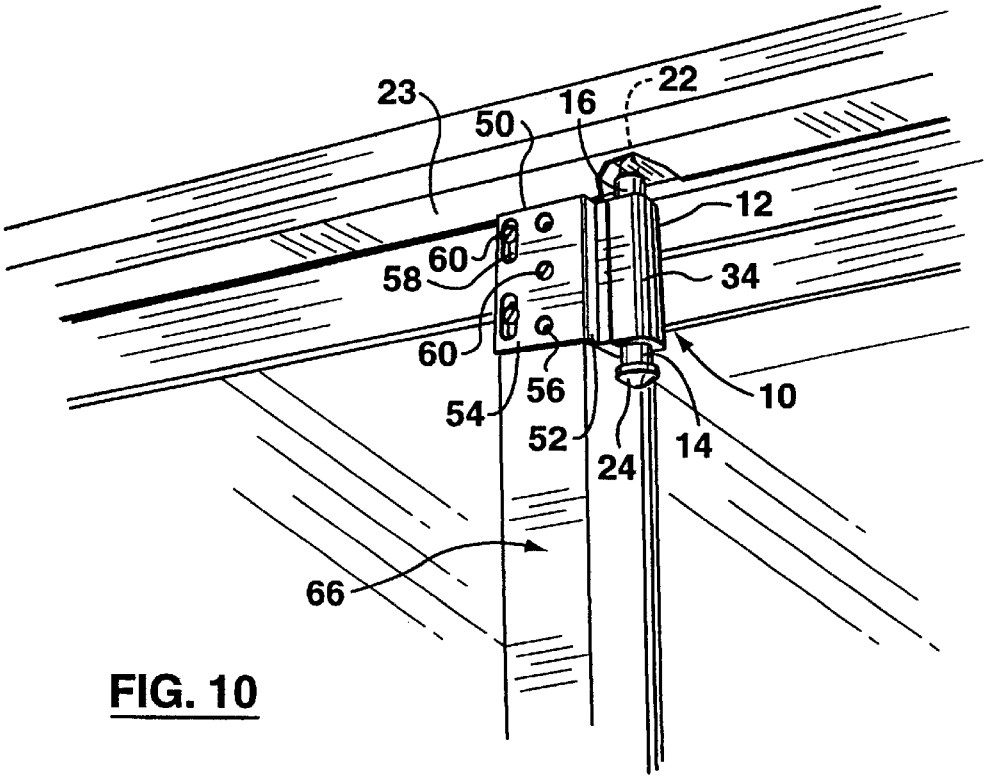
FIG. 10 is a similar view showing the lock with the mounting bracket reversed and secured to a patio door which opens from left to right.

FIG. 10 shows the lock 10 fitted to a patio door 66 which opens from right to left. In this case, the L-arm 52 (50) is detached from main housing portion 32 by removing screws 53 (see FIG. 2), and reversing the bracket 50 to the position shown in FIG. 10 and replacing the screws 53 before fitting the lock 10 to the door 66.

Figure 11:
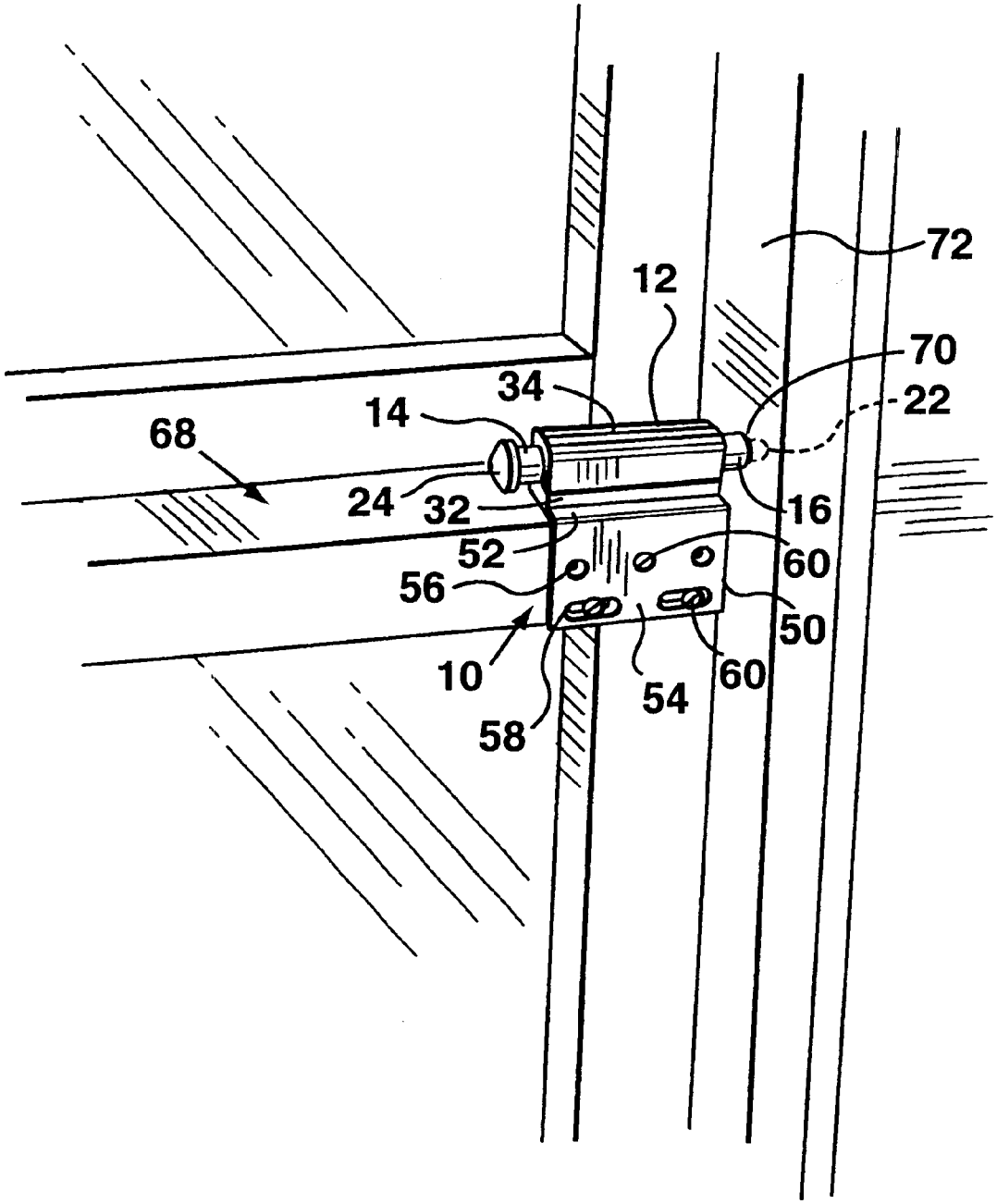
FIG. 11 is a perspective view of the lock secured to a vertically moveable window.

FIG. 11 shows the lock 10 fitted to atop corner of a vertically movable window 68, with the free end portion 22 of the plunger 16 engaging in an aperture in a side member 72 of the window frame.

The lock 10 may also be fitted to a sliding or angularly movable cupboard door, with the free end portion 22 of the plunger 16 engaging in an aperture in an adjacent door frame member.

The advantages of the invention will now be readily apparent to a person skilled in the art. Other embodiments will also now be readily apparent, the scope of the invention being defined in the appended claims.

What is claimed is:

1. A lock for preventing one member from moving relative to another member, said lock having:

a housing securable to one member, and a plunger unit removably mounted in the housing, said removable plunger unit having a sleeve, a plunger slidably mounted in the sleeve, and a helical spring surrounding the plunger within the sleeve and acting between said plunger and the sleeve to resiliently bias said plunger to a locking position in which a free end portion of the plunger projects from one end of the sleeve, the plunger also having a manually operable portion projecting from an opposite end of the sleeve, whereby in the locking position the free end portion of said plunger projects from the housing to extend into an aperture in the other member, when the housing is secured to said one member, and thereby prevent relative sliding movement between the members, said plunger also having an unlocking position in which the free end portion thereof is withdrawn from the aperture in the other member by pulling the manually operable portion against the action of the spring, the housing including a main portion and a cover portion removably securable thereto, said main portion and said cover portion having longitudinally extending recesses receiving the removable plunger unit, the cover portion being attached to the main portion by longitudinal sliding movement relative thereto, the sleeve and the housing having inter-engaging means to prevent movement of the sleeve relative to the housing, and a plurality of longitudinally spaced inter-engaging means being provided to enable the amount of projection of the free end portion of the plunger from the housing to be adjusted.

2. A lock according to claim 1 wherein the cover portion and the main portion of the housing have mutually engaging keyways to enable such sliding movement to be effected.

3. A lock according to claim 1 wherein the manually operable portion and the free end portion of the plunger are separate parts secured together by screw-threaded engagement, said separate parts being separable to enable the spring to be assembled with the plunger and the sleeve.

4. A lock according to claim 1 wherein the manually operable portion of the plunger and the sleeve have stop means which are mutually engageable by rotation of the manually operable portion of the plunger relative to the sleeve when the plunger is in the unlocking position to retain the plunger in the unlocking position.

5. A lock according to claim 2 wherein the cover portion and the main portion of the housing have mutually engaging stop means to limit movement of the cover portion relative to the housing, when the cover portion is fully assembled therewith, in a direction away from said one end of the sleeve, whereby the cover portion cannot be removed from the main portion when the lock has been installed.

6. A lock for preventing one member from moving relative to another member, said lock having:

a housing securable to one member, and a plunger unit mounted in the housing, said plunger unit having a sleeve, a plunger slidably mounted in the sleeve, and a spring acting between the plunger and the sleeve to resiliently bias the plunger to a locking position in which a free end portion of the plunger projects from one end of the sleeve, the plunger also having a manually operable portion projecting from an opposite end of the sleeve, whereby in the locking position the free end portion of the plunger projects from the housing to extend into an aperture in the other member, when the housing is secured to said one member, and thereby prevent relative sliding movement between the members, and the plunger also having an unlocking position in which the free end portion thereof is withdrawn from the aperture in the other member by pulling the manually operable portion against the action of the spring, the sleeve and the housing have inter-engaging means to prevent movement of the sleeve relative to the housing, and a plurality of longitudinally spaced said inter-engaging means being provided to enable the amount of projection of the free end portion of the plunger from the housing to be adjusted.

* * * * *